US009013257B2

(12) United States Patent
Steingroever

(10) Patent No.: US 9,013,257 B2
(45) Date of Patent: Apr. 21, 2015

(54) APPARATUS AND METHOD FOR HOLDING MAGNETIC BODIES DURING THEIR MAGNETIZATION AND FOR INSERTING THE MAGNETIZED BODIES INTO A COMPONENT OF A MAGNETIC SYSTEM

(71) Applicant: Magnet-Physik Dr. Steingroever GmbH, Köln (DE)

(72) Inventor: Dietrich Alfred Steingroever, Bergisch Gladbach (DE)

(73) Assignee: Magnet-Physik (DE)

( * ) Notice: Subject to any disclaimer, the term of this patent is extended or adjusted under 35 U.S.C. 154(b) by 0 days.

(21) Appl. No.: 13/673,388

(22) Filed: Nov. 9, 2012

(65) Prior Publication Data

US 2013/0141193 A1 Jun. 6, 2013

(30) Foreign Application Priority Data

Nov. 11, 2011 (DE) ..... 10 2011 086 214

(51) Int. Cl.
*H01F 7/20* (2006.01)
*H01F 13/00* (2006.01)

(52) U.S. Cl.
CPC ..... *H01F 13/003* (2013.01)

(58) Field of Classification Search
USPC ..... 335/284, 285, 286; 29/586, 289
See application file for complete search history.

(56) References Cited

U.S. PATENT DOCUMENTS 4,444,550 A * 4/1984 Loubier ..... 425/3
2005/0210663 A1 9/2005 Ishida et al.

FOREIGN PATENT DOCUMENTS

DE 102009028881 3/2011
DE 102009048343 4/2011
JP 55111645 8/1980

OTHER PUBLICATIONS

German Examination Report dated Jun. 5, 2012 issued in German Patent Application No. 10 2011 086 214.5. English language machine translation provided, 12 pages.

* cited by examiner

*Primary Examiner* — Bernard Rojas
(74) *Attorney, Agent, or Firm* — Grossman Tucker Perreault & Pfleger PLLC

(57) ABSTRACT

For simplifying the handling of magnet bodies during magnetization and for inserting the magnetized magnet bodies into a component of a magnetic system such as an electromagnetic drive, a magnetic travel or angle system or the like, an apparatus is proposed which includes a plurality of cavities for receiving at least one magnet body respectively, wherein the magazine comprises a plurality of interconnected and mutually movable magazine elements. The invention further relates to a method for holding magnet bodies during their magnetization and for inserting the magnetized magnet bodies into a component of a magnetic system and to a magnet body handling system.

Figures 1, 2, 3:
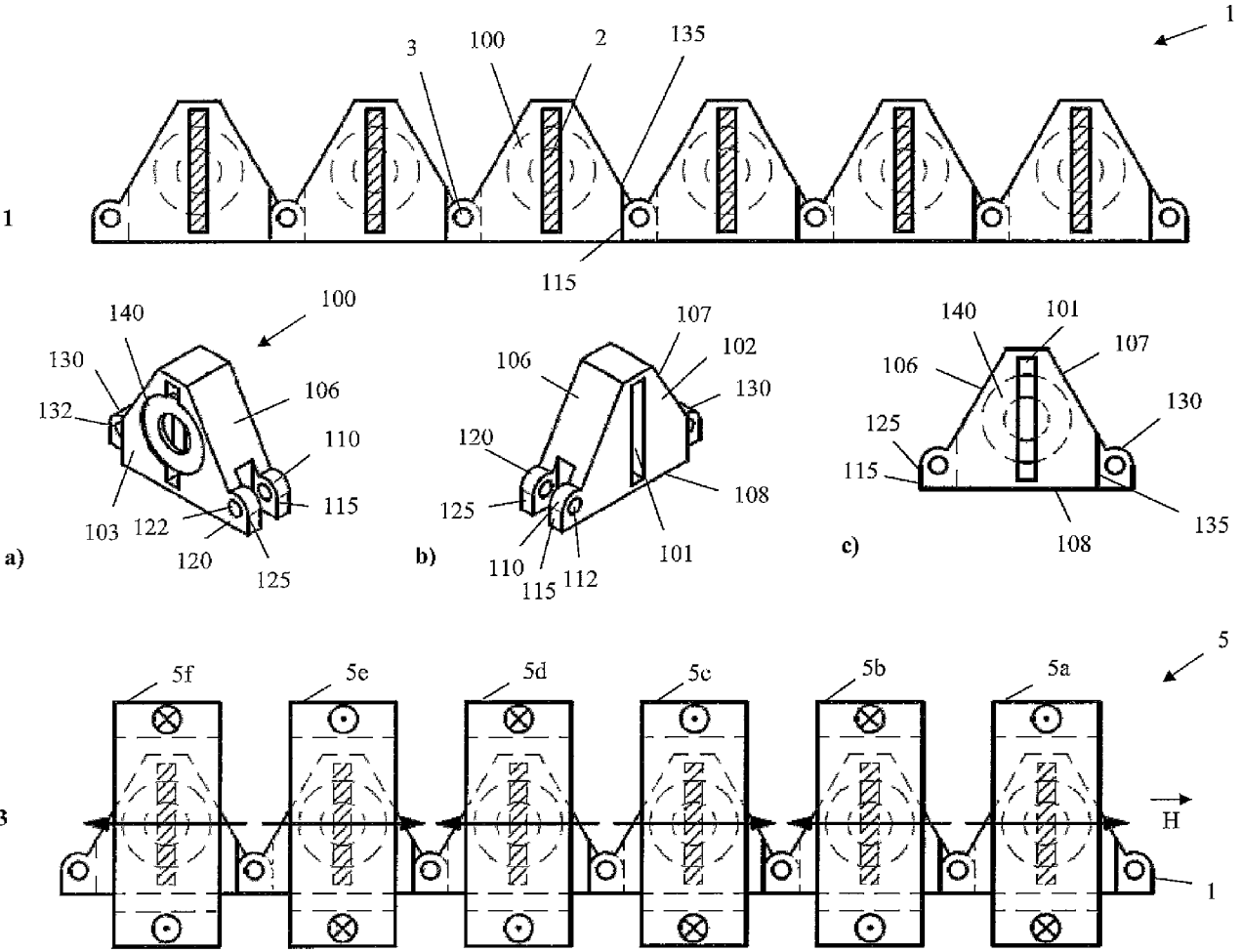

19 Claims, 16 Drawing Sheets a) b)

300
312a
321
320
312a
312b
A3
A2
A1
312b
312a
200
215
200
215
200
211
210
201
200
205
215
200
199
220
310
230
231
199
200
206
200
200
200

APPARATUS AND METHOD FOR HOLDING MAGNETIC BODIES DURING THEIR MAGNETIZATION AND FOR INSERTING THE MAGNETIZED BODIES INTO A COMPONENT OF A MAGNETIC SYSTEM

The invention relates to an apparatus and a method for holding magnet bodies during their magnetization and for inserting the magnetized magnet bodies into a component of a magnetic system such as an electromagnetic drive, a magnetic travel or angle system or the like. The invention further relates to a magnet body handling system including such an apparatus and an associated magnetization arrangement such as a coil arrangement, for magnetizing magnet bodies received in the magazine.

In the fields of electric and electronic engineering, permanent magnets are used in a plurality of applications. This applies for instance to electric motors such as self-excited direct current motors, synchronous motors, permanent magnet generators as used for instance in modern wind power plants, in bicycle dynamos and also in electric motors or generators in the automotive sector.

At the production of such permanent magnets, powder-metallurgical processes are frequently employed or also processes in which the magnetizable particles are present in the magnet body in a plastic-bound form. Such production processes have in common that after its production the magnet body must be magnetized by aligning the elementary magnets by means of an outer magnetic field. A method and apparatus for the production of such a magnetizable magnet body are described for example in German patent application publication DE 10 2009 028 881 A1.

Particularly in cases where several thus produced magnet bodies with aligned elementary magnets have to be inserted into a component of a magnetic system such as a rotor of an electric generator, several working steps are required which finally increase time and cost of the production of the magnetic system.

It is an object of the present invention to reduce time and cost of the production of a magnetic system such as an electromagnetic drive, a magnetic travel or angle system or the like, comprising permanent magnets. The invention surprisingly solves that problem alone by an apparatus for holding magnet bodies during their magnetization and for inserting the magnetized magnet bodies into a component of a magnetic system comprising the features of claim 1. The apparatus of the invention is characterized in that it is constructed as a magazine with a plurality of cavities for receiving at least one magnet body respectively, the magazine comprising a plurality of magazine elements that are connected to each other and that are movable with respect to each other. A single magazine element has at least one cavity for receiving a magnet body.

The provision of the apparatus of the invention considerably simplifies the handling of the magnet bodies to be magnetized and inserted into a component of a magnetic system. As a result of the magazine being constructed with several magazine elements that are movable with respect to each other and that include a number of magnet bodies received in said cavities, the apparatus or the magazine elements thereof can be optimally aligned for magnetization and also for subsequent insertion of the magnetized magnet bodies into the component of the magnetic system such as a rotor of a permanent magnet generator. This particularly allows for an automation of the working steps required and accordingly for a considerable saving of production time and cost.

It should be noted that a respective cavity in the magazine is not required to represent a closed hollow space but can also include or usually includes at least one opening, particularly for inserting and removing a magnet body assigned to that cavity. Such a cavity can also be formed for example by a slot or a groove in the magazine or in a magazine element, said groove or said slot providing a hollow space for receiving at least one magnet body.

Such a hollow space in a magazine or in a magazine element can be constructed for receiving a specially shaped magnet body, for example for receiving cuboid or cylindrical magnet bodies, and the cavity can be adapted to the magnet body to be received. In particular, such an adaption can consist in that a magnet body which is received contacts the inner wall of the hollow space, at least in sections.

Depending on the configuration of the component of the magnetic system into which the magnet bodies are inserted from the magazine, a magazine element can of course also include several, for example two or three, cavities, and each cavity can again receive a single magnet body or also several magnet bodies, depending on the respective specific application.

Further features and embodiments of the present invention are stated in the subclaims and will become apparent from the following description.

Preferably, the magazine can be manufactured from a non-magnetic material such as austenitic steel, which makes it easier for the magnet bodies to move within the cavities of the magazine, for instance during the insertion and/or removal of the magnet bodies, because the magnet bodies cannot magnetically interact with the material of the magazine.

On the other hand, in particular applications, the magazine can however be manufactured precisely from a magnetizable material or can comprise such a material, for optimizing for example the magnetization field during the magnetization of the magnet bodies received in the cavities of the magazine.

Preferably, the magazine elements of the apparatus are connected to each other in a chain-like or articulated manner and so that at least one magazine element is movably connected to two adjacent magazine elements respectively. In one embodiment, in which magazine elements are movably connected to precisely two neighboring elements, the resulting configuration of the magazine is chain-like, wherein each magazine element represents a single chain link of that chain. Such a design affords high flexibility of the magazine regarding a possible three-dimensional arrangement of the individual magazine elements with respect to each other, whereby the orientation of the magnet bodies contained in the cavities with respect to the magnetization field and/or the orientation of the magnet bodies for the subsequent transfer of the magnet bodies to a component of a magnetic system are simplified.

Preferably, between two directly adjacent magazine elements precisely one motional degree of freedom is provided, which simplifies magazine handling. In the simplest case, that degree of freedom is provided by a rotational axis, with mutually adjacent magazine elements arranged about that axis so that the same are rotatable with respect to each other. Such configuration of the magazine of the invention allows the magazine being easily given the configuration of a linear chain or also a circle or circular segment configuration, wherein the former may be expedient especially in the magnetization of the magnet bodies retained in the magazine, particularly because it allows the use of a linear coil for magnetization. A formability of the magazine to such an extent that a circle or circular segment configuration can be adjusted, can be particularly useful where the magnet bodies after magnetization have to be inserted into a usually circular rotor, which rotor can be copied due to the mobility of the individual magazine elements with respect to each other. As a result of that "copying" of the rotor, a plurality of magazine cavities can be aligned with rotor cavities so that magnet bodies stored in the magazine cavities can be transferred to corresponding rotor cavities in a greatly simplified manner.

Particularly preferably, precisely two motional degrees of freedom can be provided between mutually adjacent magazine elements, wherein these two degrees of freedom can be rotational degrees of freedom respectively that can be provided by a rotational axis. Such an embodiment of the magazine of the invention further facilitates the handling of the magazine, particularly with regard to the transformation of the magazine from a first to a second configuration. Due to said two degrees of freedom between adjacent magazine elements, the relative mobility of said two adjacent magazine elements with respect to each other is increased so that such a magazine of the invention can be particularly easily given the configuration of a linear chain or a circle or circular segment configuration, for example for magnetizing magnets retained in the magazine where the magazine has the configuration of a linear chain, and for transferring the magnet bodies to a magnetic system after magnetization where the magazine has been given the a circle or circular segment configuration as described above with regard to a magazine according to the invention in which a single degree of freedom between two adjacent magazine elements is provided.

Preferably, the provision of two degrees of freedom between two adjacent magazine elements can be implemented by an elongate connecting element being arranged between and pivoted to two adjacent magazine elements, wherein both associated rotational axes can preferably be oriented parallel to each other. Advantageously, the elongate connecting element is rigid in order to restrict the movement between two adjacent magazine elements to precisely the said two degrees of freedom.

To afford high rotational mobility between adjacent magazine elements, the arrangement of the elongate connecting element between adjacent magazine elements can be so that after adjusting the magazine to a circle or circular segment configuration, the rotational axes and particularly all rotational axes for coupling the respective connecting elements to the magazine lie on a circle or circular segment, wherein the circumferential spacing of said two rotational axes of a magazine element is smaller than half of the total circumferential extension of a magazine element. Preferably, the two rotational axes of a magazine element extend through the magazine element, and the circumferential spacing between these rotational axes is limited as mentioned above.

Preferably, a cavity of a magazine element for receiving a magnet body has an extension edge that is oriented approximately parallel to the rotational axis of the interconnected and adjacent magazine elements. On the other hand, also other orientations of the cavity relative to the rotational axis of the interconnected and adjacent magazine elements can be expedient, for example in cases where the magnet bodies must be transferred from the magazine to a rotor in which the cavities are not parallel to the rotor axis but are tilted with respect to the rotor axis.

To facilitate adjusting of the relative positions of the individual magazine elements with respect to each other, for magnetization of the magnet bodies received therein and/or for transferring the magnet bodies into the component of a magnetic system, it can be provided that adjacent magazine elements have cooperating contact surfaces for fixing mutual orientation positions, particularly for fixing two end positions in the movement of two adjacent and interconnected magazine elements relative to each other.

Normally, a plurality of connecting devices can be used for the connection of two adjacent magazine elements, the only condition being that the connecting device permits a relative movement of the magazine elements which are connected to each other. A particularly simple form of such a connecting device is provided by a hinge-type connection.

For inserting and/or removing a magnet body, a cavity of a magazine element preferably includes an opening, which in most applications is not required to be closable.

For supporting the magnet body in the cavity in which it is received, said cavity includes a support, particularly on the opposite side from said opening.

On the other hand, such a cavity in a magazine element can also be open on two sides, particularly on two mutually opposite sides, for instance in cases where the material arranged with respect to the surrounding cavity is magnetizable so that the magnet body is magnetically retained within the cavity.

For facilitating handling by using a magazine of the invention, particularly for facilitating the adjustment of predetermined orientations of the magazine elements with respect to each other and for fixing the adjusted position of the individual magazine elements with respect to each other, it can be useful if each of two adjacent and interconnected magazine elements includes complementary locking devices for locking said two magazine elements in at least one relative position. Such locking can be implemented for instance by an elastic locking element that is attached to one of the magazine elements and that snaps in place in a corresponding locking recess provided on the adjacent magazine element when the adjacent magazine elements have a predetermined orientation relative to each other. Preferably, said interlocking connection can be configured so as to be releasable upon exertion of an increased force so that the two adjacent and interlocked magazine elements are again freely movable with respect to each other.

For improving the flexibility of the inventive apparatus for holding magnet bodies during their magnetization and for inserting the magnetized magnet bodies into a component of a magnetic system with regard to the orientation of the magnet bodies, particularly with regard to their magnetization direction, it can be provided for adjacent magazine elements to include a base body and, relatively rotatable with respect to said base body, a respective magnet body receiver, wherein a magnet body receiver provides the at least one cavity of the respective magazine element for receiving a magnet body. By this design feature it is possible to achieve the optimal orientation of the magnet body with respect to the magnetizing field during magnetization and/or of the magnetized magnet body with respect to its magnetization direction during the insertion into the component of the magnetic system. Preferably, in this embodiment, the base bodies of the magazine elements can be connected to each other in a chain-like manner so that at least one base body of a magazine element is movably connected to both base bodies of the adjacent magazine elements. Preferably, two motional degrees of freedom are provided between the base bodies of adjacent magazine elements, said degrees of freedom being rotational degrees of freedom. Preferably, between two adjacent magazine elements an elongate connecting element can be disposed, which is pivoted to both adjacent base bodies, and both associated rotational axes are oriented parallel to each other. Preferably, by aligning the mutually movable base bodies of the magazine elements, the magazine can be given the configuration of a substantially linear chain and/or the a circle or circular segment configuration so that the apparatus according to the invention can be optimally adjusted for the magnetization and/or insertion of the magnet bodies into the magnetic system.

According to the invention, the movement of the magnet body receivers that arranged so as to be rotatable relative to the base body can be implemented in different ways. For instance, the magnet body receiver can be arranged relative to the base body so as to be manually rotatable with respect to the base body. Moreover, a controllable electric or manual driving mechanism can be provided for example, whereas a configuration in which a magnet body receiver is movably coupled to the base body of an adjacent magazine is particularly preferred. Such movable coupling can be configured so that the magnet body receiver is automatically rotated relative to its base body with the alignment of the mutually movable base bodies of adjacent magazine elements. This movable coupling can for instance be such that when a linear chain of the magazine is adjusted, the supported magnet bodies are oriented to the magnetization field in a predetermined manner and/or such that when a second configuration of the magazine is adjusted, e.g. a circle or circular segment configuration, the supported magnet bodies are optimally oriented for insertion thereof into the component of the magnetic system.

The object of the present invention stated above is also achieved by a method for holding magnet bodies during their magnetization and for inserting the magnetized magnet bodies into a component of a magnetic system, the method comprising the following steps:

A) Providing a magazine having a plurality of cavities, each of which being configured for receiving at least one magnet body, wherein the magazine has a plurality of interconnected and mutually movable magazine elements;
B) Loading the magazine with a plurality of magnet bodies;
C) Adjusting a first predetermined configuration of the magazine by moving individual magazine elements relative to each other;
D) Magnetization of magnet bodies retained in the magazine, while the magazine assumes the first predetermined configuration;
E) Adjusting a second predetermined configuration of the magazine by moving individual magazine elements relative to each other;
F) Transferring the magnetized magnet bodies to a component of a magnetic system, while the magazine assumes the second predetermined configuration.

The use of a supporting device in the form of a magazine that can be adjusted for the respective purpose of both magnetization and insertion of the magnetized magnet bodies into the respective component of a magnetic system clearly reduces the workload in the production of a magnet component of any kind comprising a plurality of permanent magnets. It should be noted that the above steps A)-F) of the method of the invention are not fixed to the order of A), B), C), D), E), and F) of the steps of the method in all embodiments of the invention. Instead, carrying out the steps of the method in the order of A), C), B), D), E), and F) also is within the scope of the invention and of the attached claims.

It should be noted that according to the invention the magnet bodies received in the magazine need not be magnetized simultaneously in all embodiments. It is also possible for example to feed the magazine to a magnetization apparatus step-by-step and in a clocked manner so that the magnet bodies retained in the magazine are magnetized in a plurality of steps, and the configuration of the magazine which is set at each work cycle can also be that configuration which has been assigned to a magazine section present in the magnetization device.

Depending on the embodiment of the invention, the step of loading the magazine with a plurality of magnet bodies can comprise the insertion of the respective magnet bodies into the corresponding cavity in the magazine on the one side. On the other side, this step can also include the insertion and consolidation of magnetic particles within the cavities of the magazine so that in this embodiment of the method of the invention the production of the magnet body also takes place in the magazine. In this embodiment, for example, metal powder and synthetic binders can be added. Thereafter the magnet bodies will become cured in the cavity and can then be subjected to the magnetization step and finally transferred to a component of a magnetic system.

Preferably, the step of magnetizing the magnet bodies retained in the magazine at least comprises inserting the loaded magazine into a magnetization coil, exciting the magnetization coil for generating the magnetization field, and removing the magazine from the magnetization coil.

For preparing the transfer of the magnetized magnet bodies retained in the magazine to a component of a magnetic system, the step of transferring the magnetized magnet bodies to a component of a magnetic system can at least comprise aligning the loaded magazine which has assumed its second configuration with the magnetic system component and removing the magnet bodies from the respective magazine cavities and inserting the magnet bodies into corresponding cavities in the component of the magnetic system. Such alignment can be implemented for example by aligning the openings of the magazine cavities with openings of corresponding component cavities of the magnetic system by orienting the magazine which has assumed its second configuration relative to the component.

As it can be kinematically easily implemented, it is particularly preferable for the magnet bodies being moved from the respective magazine cavity into a corresponding aligned cavity in the component of the magnetic system through a linear movement.

Normally, each magnet body can be discretely moved from a magazine cavity into the corresponding cavity of the magnetic system component, for example by means of a pusher-type finger, and a considerable time saving is achieved by the use of a pusher-type post having a plurality of fingers that are each aligned with a magazine cavity and by which a plurality of magnet bodies, particularly preferably all magnet bodies, can be simultaneously transferred and preferably shifted to the magnetic system component in a single work step.

For loading a component of a magnetic system with magnetized magnet bodies, the invention also provides for the use of two or more of the above-described magazines, while the magnetization of the magnet bodies in the different magazines can be different and the magnet bodies retained in said two magazines are inserted into the magnetic system component one after the other.

The invention further relates to a handling system for magnet bodies which comprises a magazine according to the above-described configurations and a magnetization arrangement for magnetizing magnet bodies received in the magazine. Preferably, the magnetization arrangement is adjusted to the configuration of the magazine, particularly to the orientation of the magnet bodies received in the magazine, for obtaining a predetermined directional magnetization.

Preferably, the handling system of the invention further comprises a device for transferring the magnetized magnet bodies from the magazine to the component of the magnetic system, for example in the form of a pusher-type post having a plurality of fingers that are each assigned to a cavity, for transferring, e.g. shifting, the magnet bodies to/into corresponding cavities in the component of the magnetic system.

In a particularly preferred embodiment of a handling system of the invention the same comprises a plate-like guiding device having a guide groove. This guide groove comprises at least two merging sections, wherein a magazine is forcibly or positively guided in said guide groove, for the sequential adjustment of the first and the second magazine configuration. It can be provided for the magazine having protrusions engaging the guide groove of the guiding device so that the magazine is positively guided. This positive guiding can be such that the magazine is transformable from a first configuration, e.g. a linear chain configuration, in which the magnet bodies are subject to magnetization, to a second configuration, e.g. a circle or circular segment configuration, in which the magnet bodies can be transferred to a component of a magnetic system such as a rotor of an electric motor, particularly in a motor-driven manner. It can be particularly useful if said protrusions are disposed at the position on the mutually movable magazine elements where the rotational axes are located, and said protrusions can also extend parallel to the rotational axis, particularly in the form of extensions of a rotational axis such as axle journals.

An embodiment which is particularly preferable can be one in which one magazine element of the magazine is assigned two rotation axes through which the magazine element is coupled to a connecting element respectively that can be elongate and that is coupled on its other end to an adjacent magazine element by means of a rotational axis.

A particularly preferable embodiment of a handling system configured according to the invention is obtained by such a plate-like guiding device including two mutually spaced guide grooves, which each comprise at least two merging sections, and the two guide grooves can extend linearly and parallel to each other in a first section and circularly, with opposed directions of rotation, in a second section. Preferably, such configuration allows for instance the simultaneous handling, particularly the insertion and magnetization, of magnet bodies in two mutually spaced magazines, wherein by a change of the configuration of the magazines to their second configuration as a result of the opposed directions of rotation, magnet bodies having a magnetization offset to each other by 180 degrees can be provided which can be transferred one after the other to a component of an electric system such as a rotor of an electric motor. Here it is useful if both magazines that are positively guided in the guiding device are moved by means of a single driving device that acts on both magazines.

Figure 4:
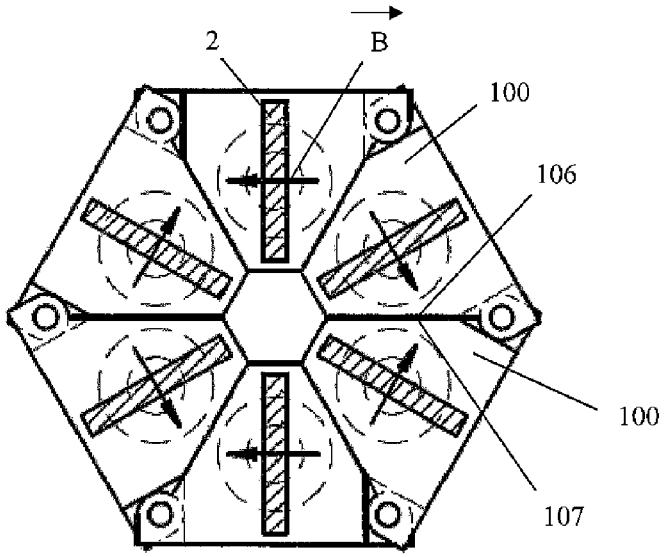
Figure 5:
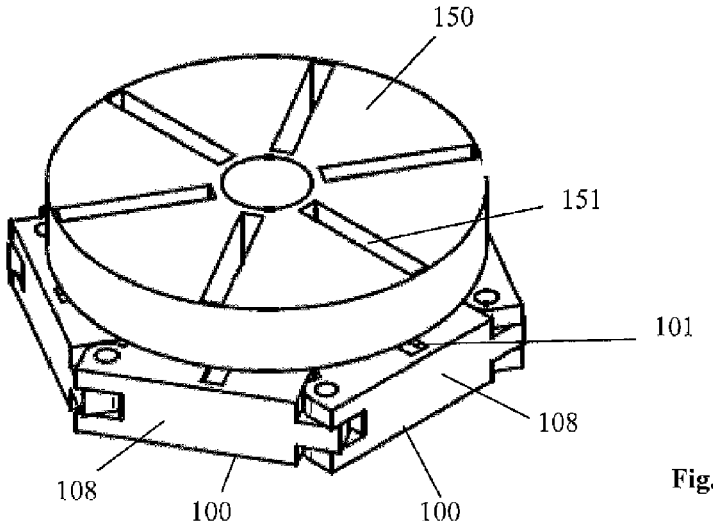
Figure 6:
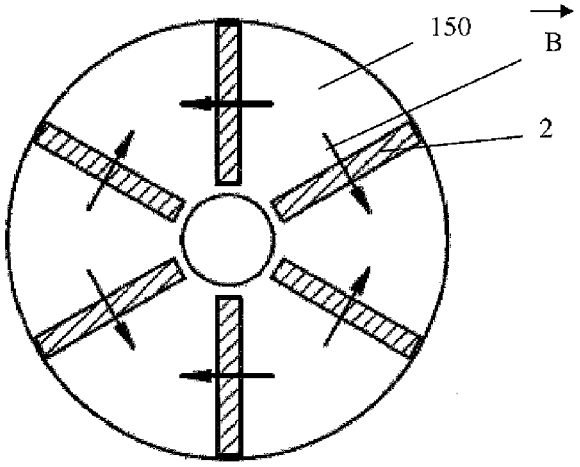
Figure 7:
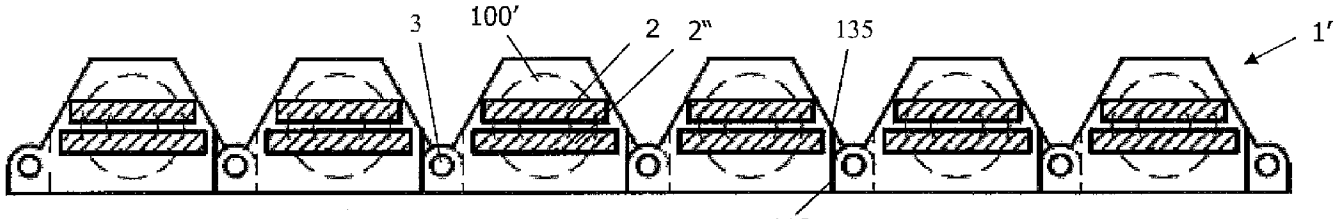
Figure 8:
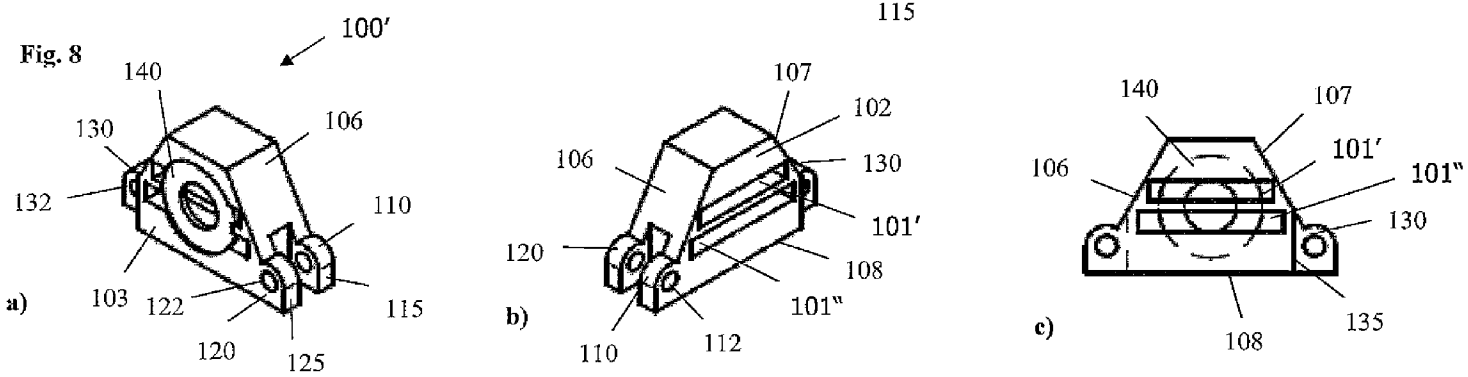
Figure 9:
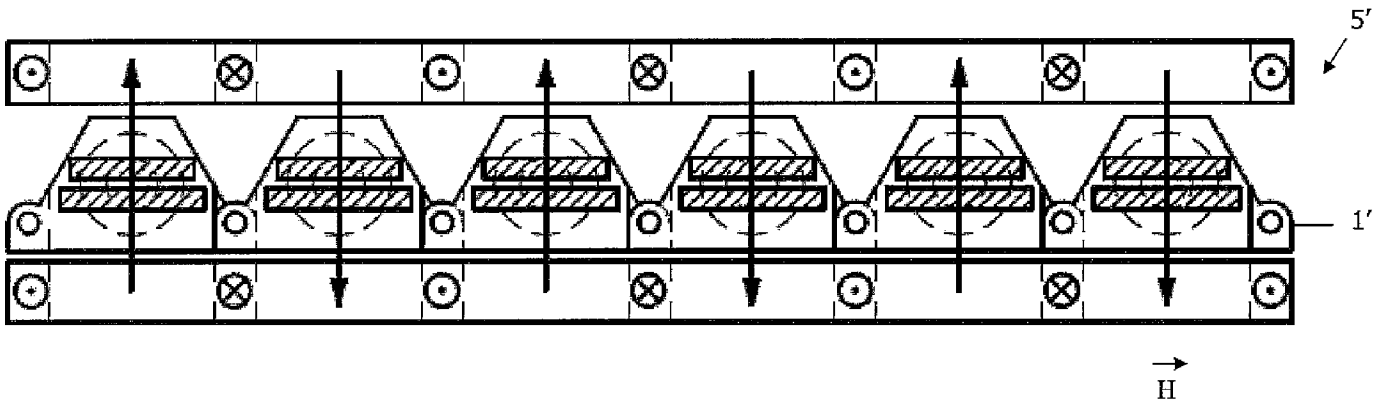
Figure 10:
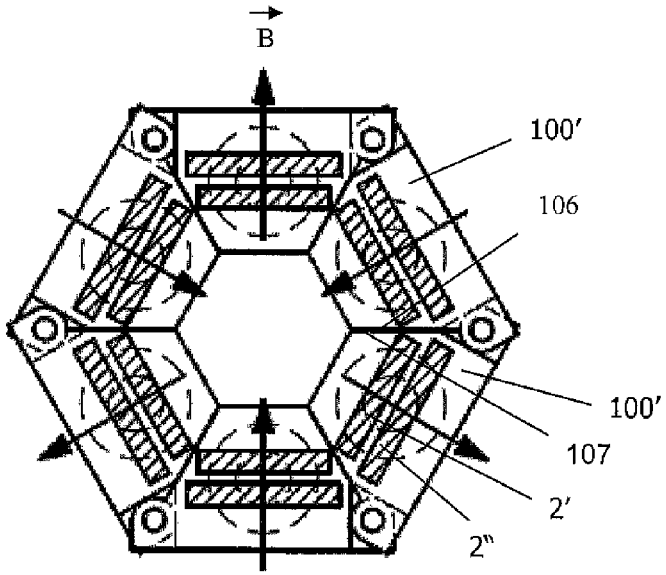
Figure 11:
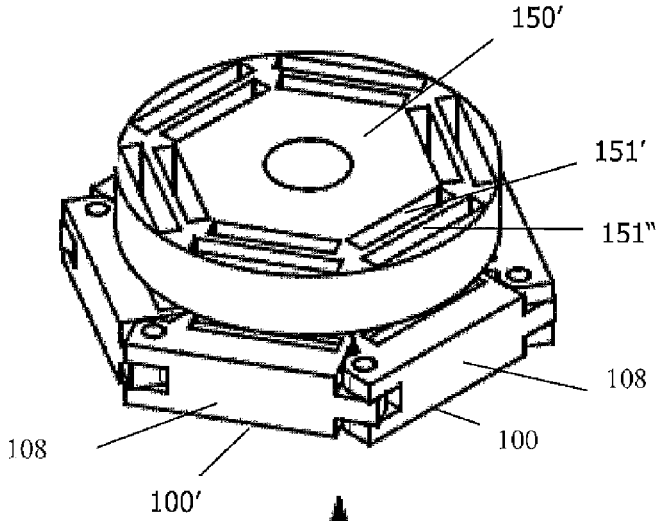
Figure 12:
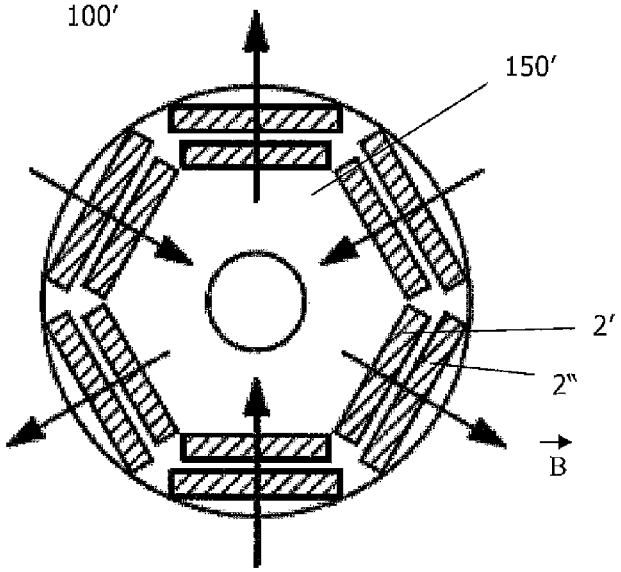
Figure 13:
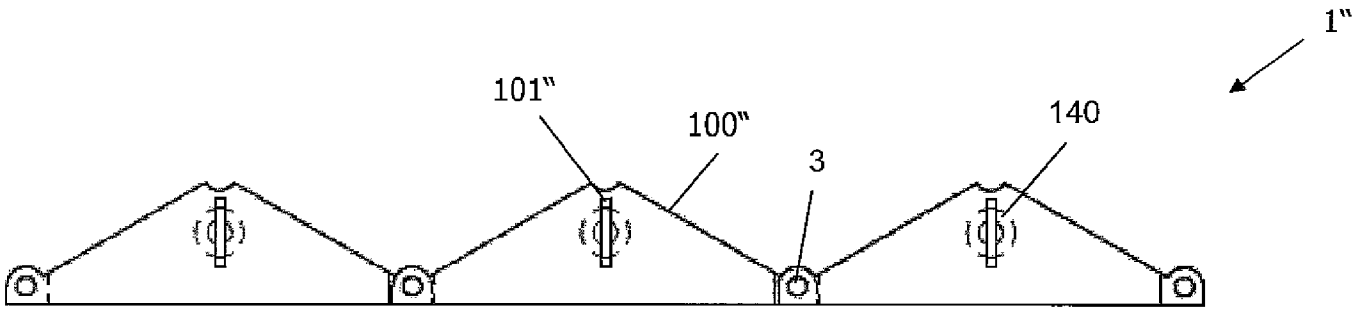
Figure 14:
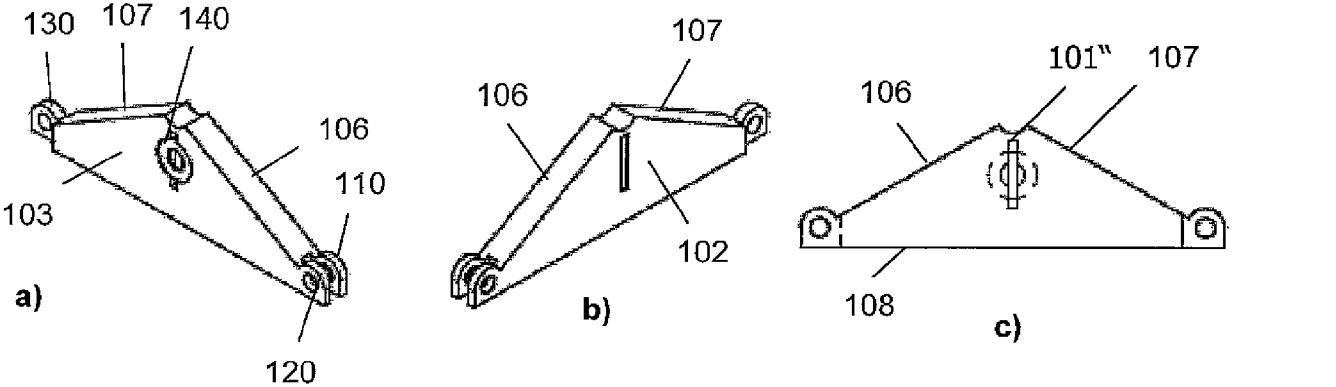
Figure 15:
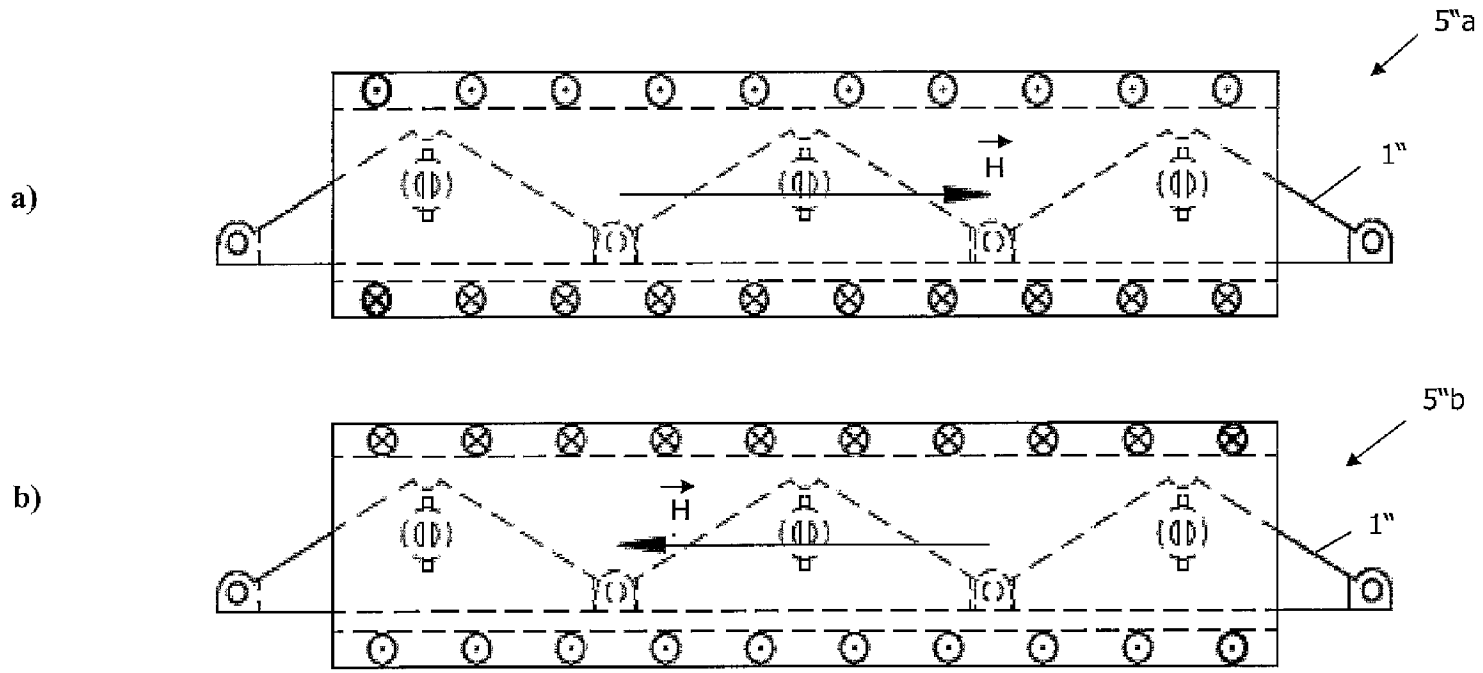
Figure 16:
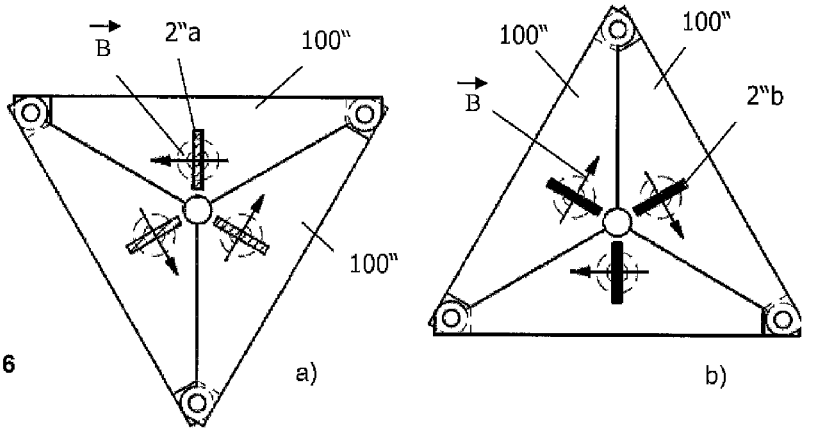
Figure 17:
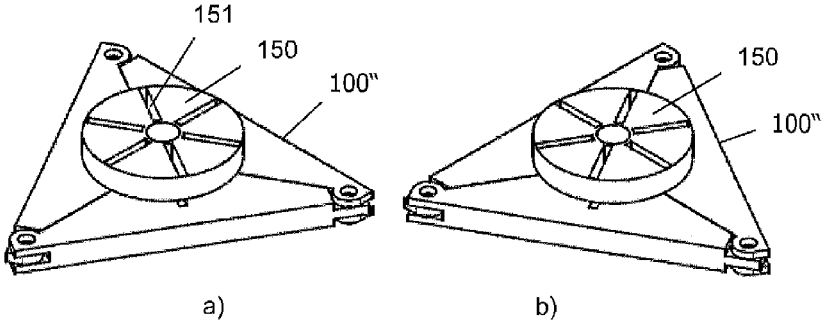
Figure 18:
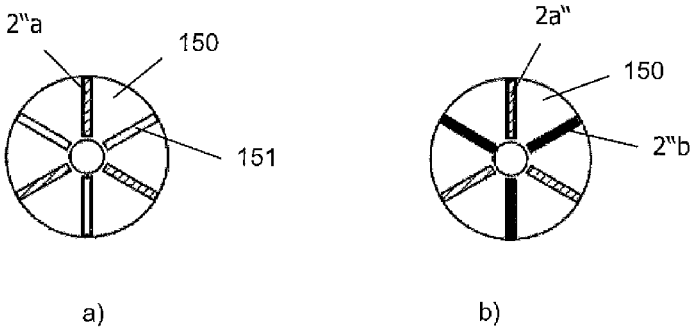
Figure 19:
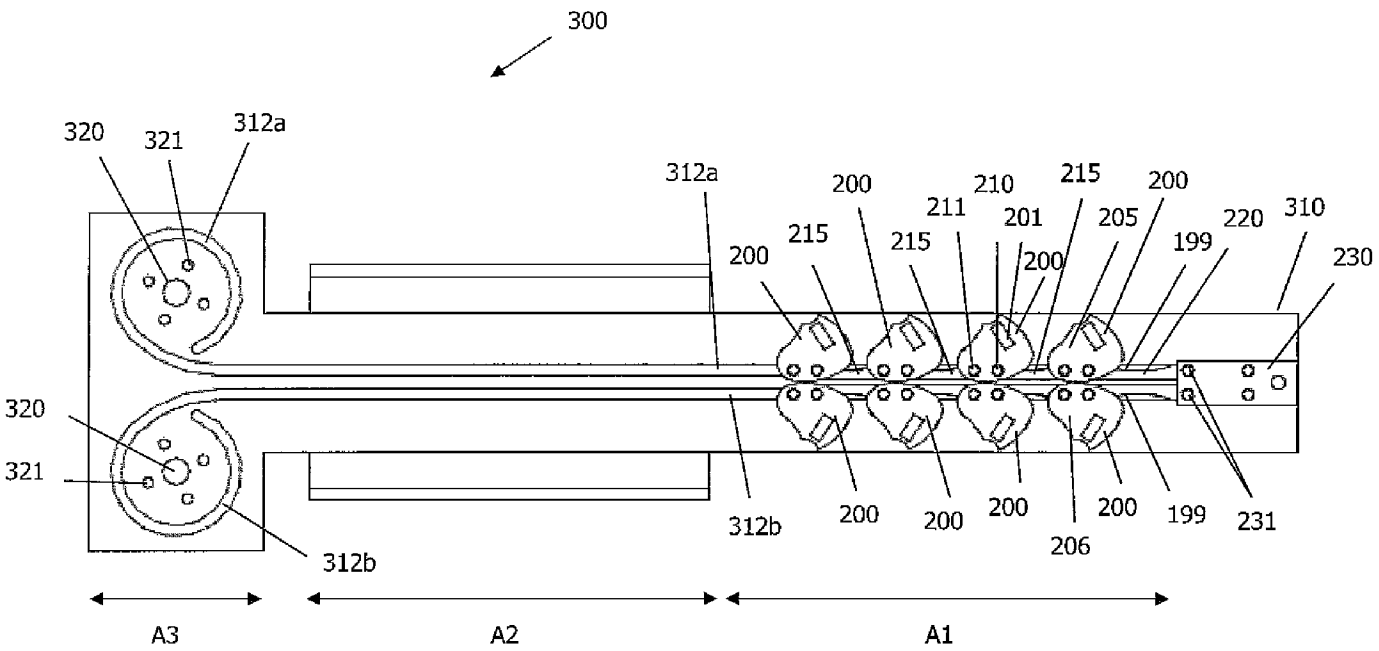
Figure 20:
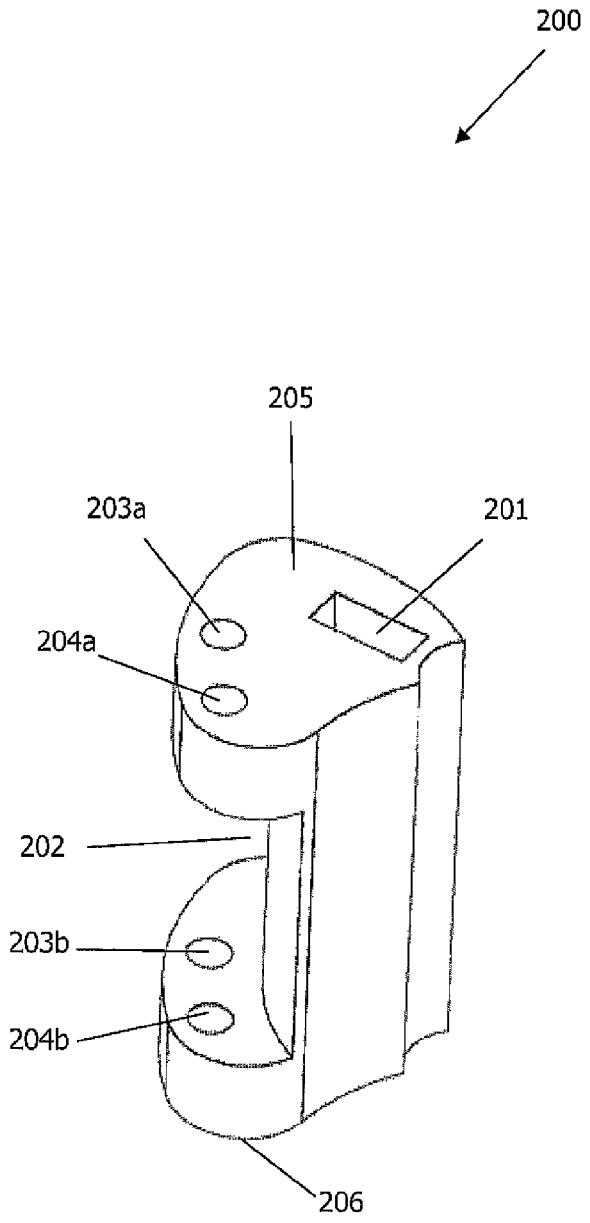
Figure 21:
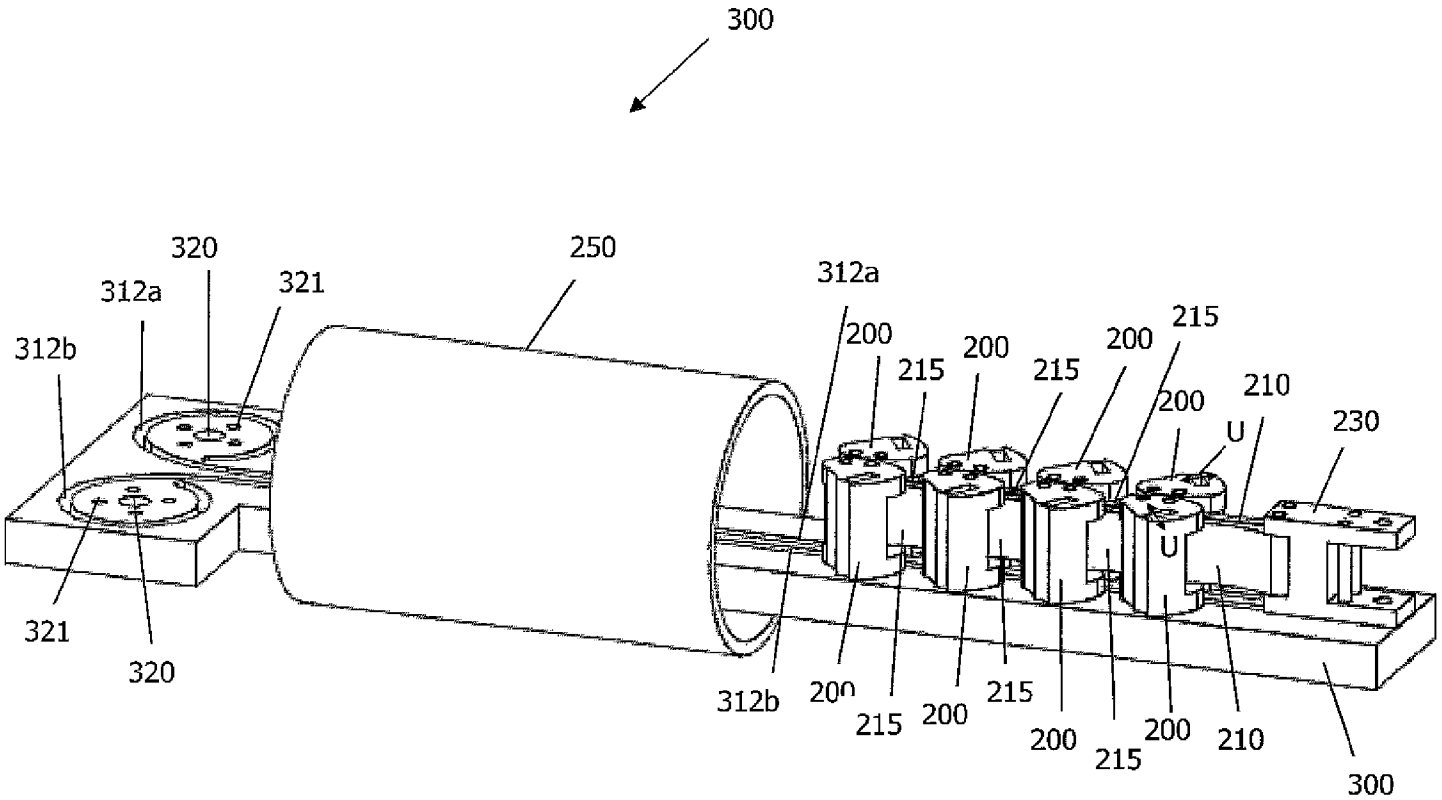
Figure 22:
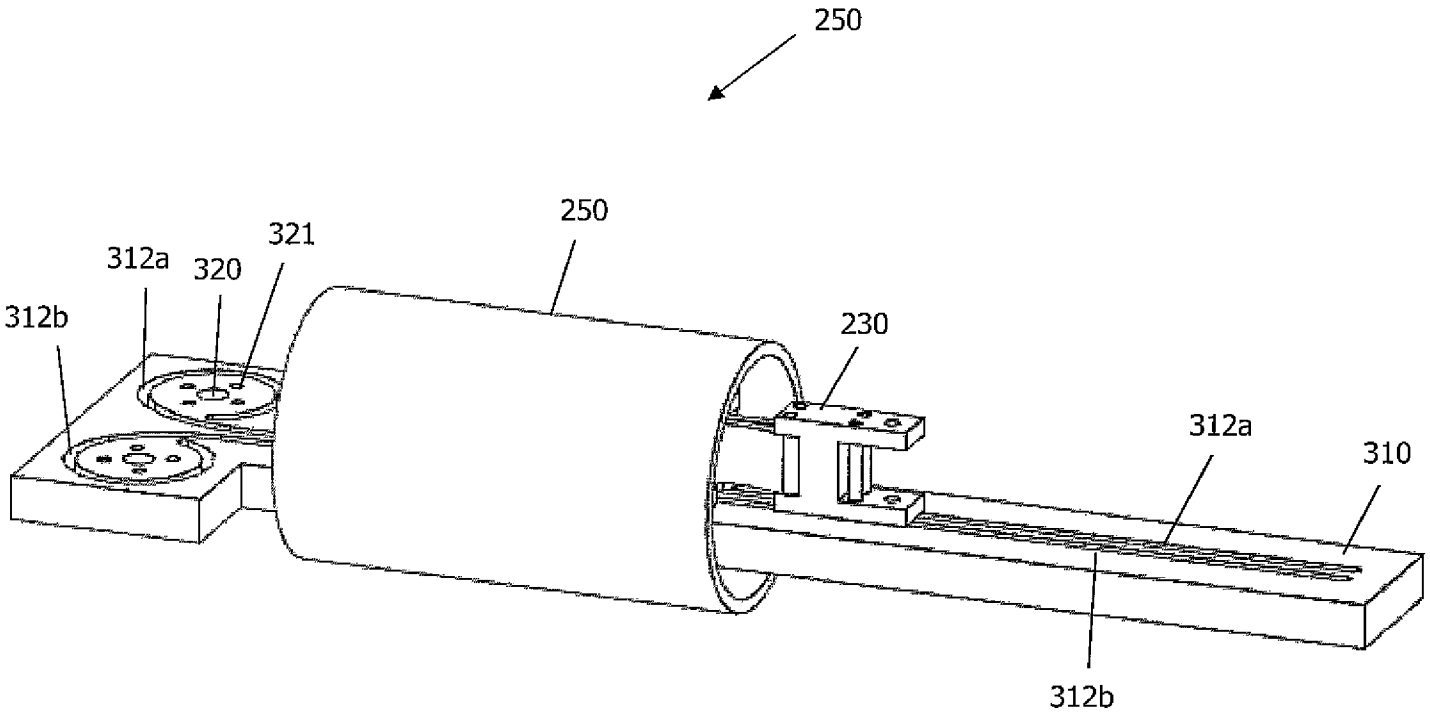
Figure 23:
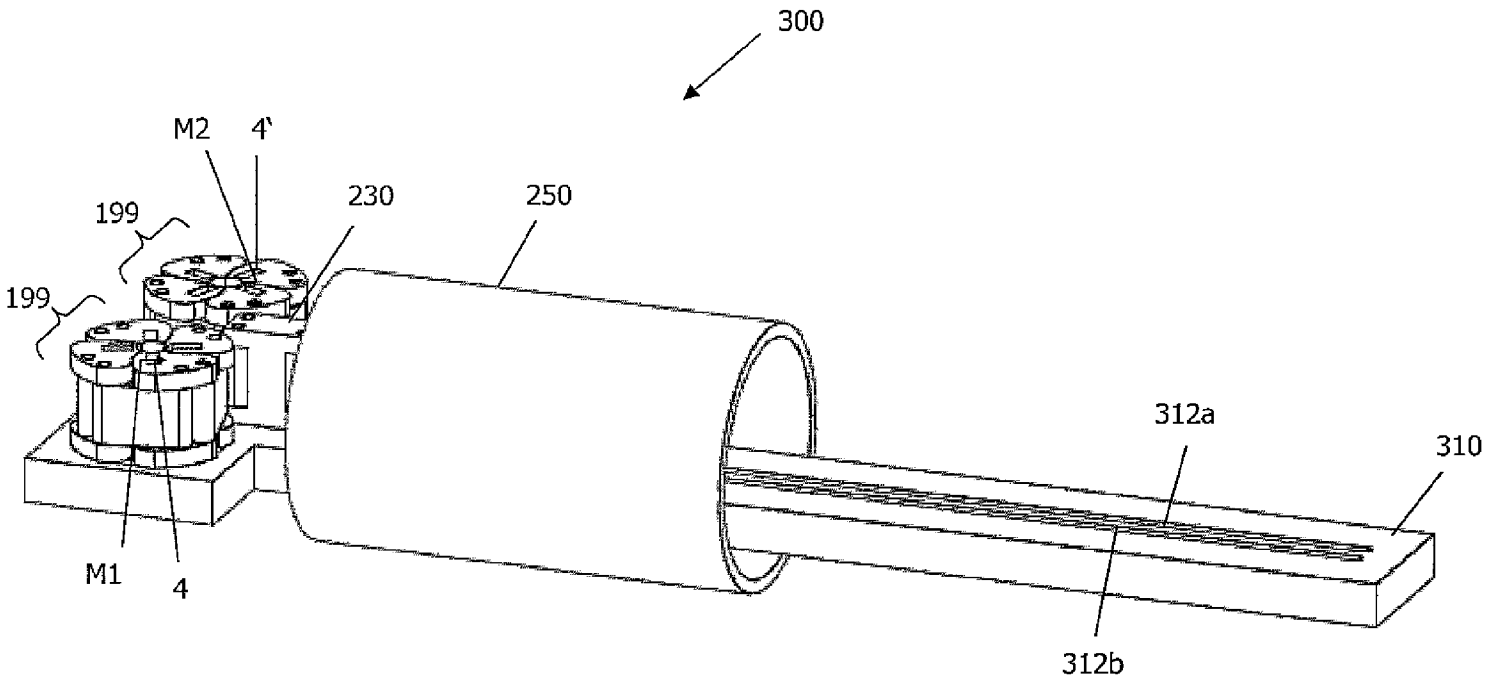
Figure 24:
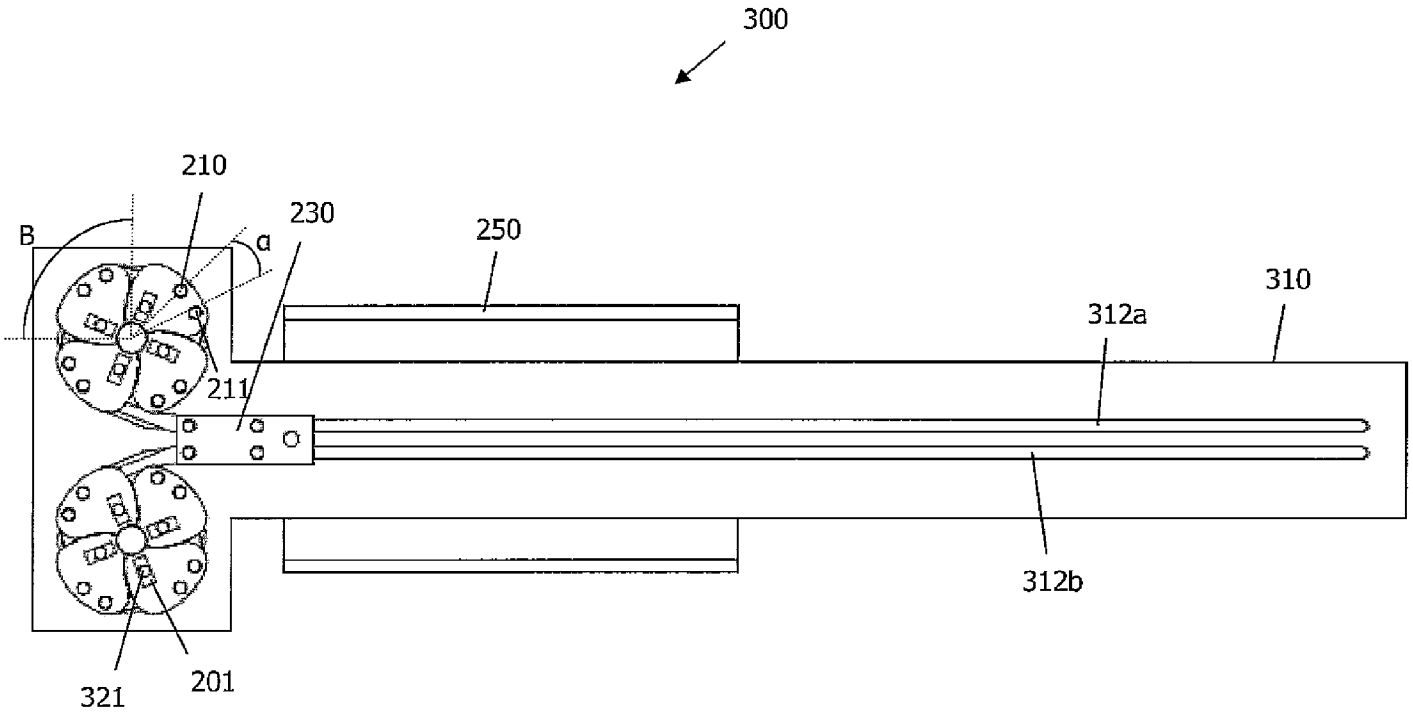
Figure 25:
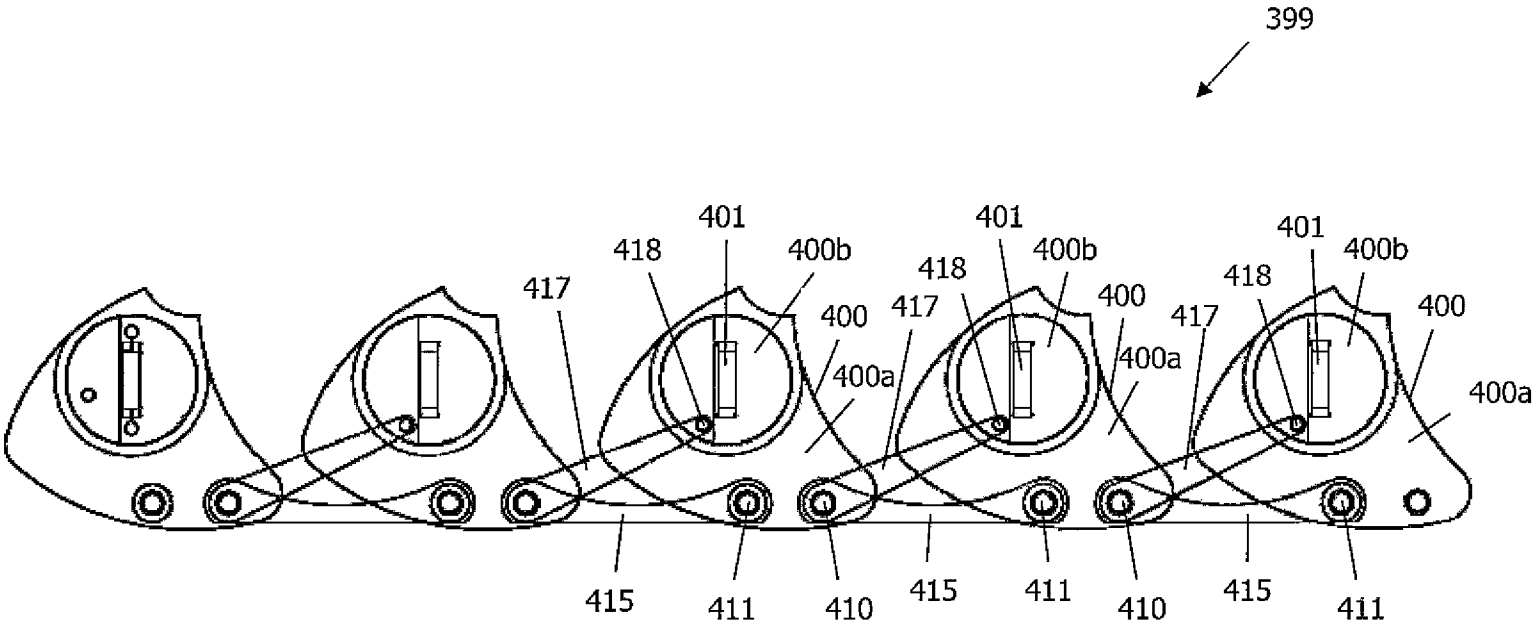
Figure 26:
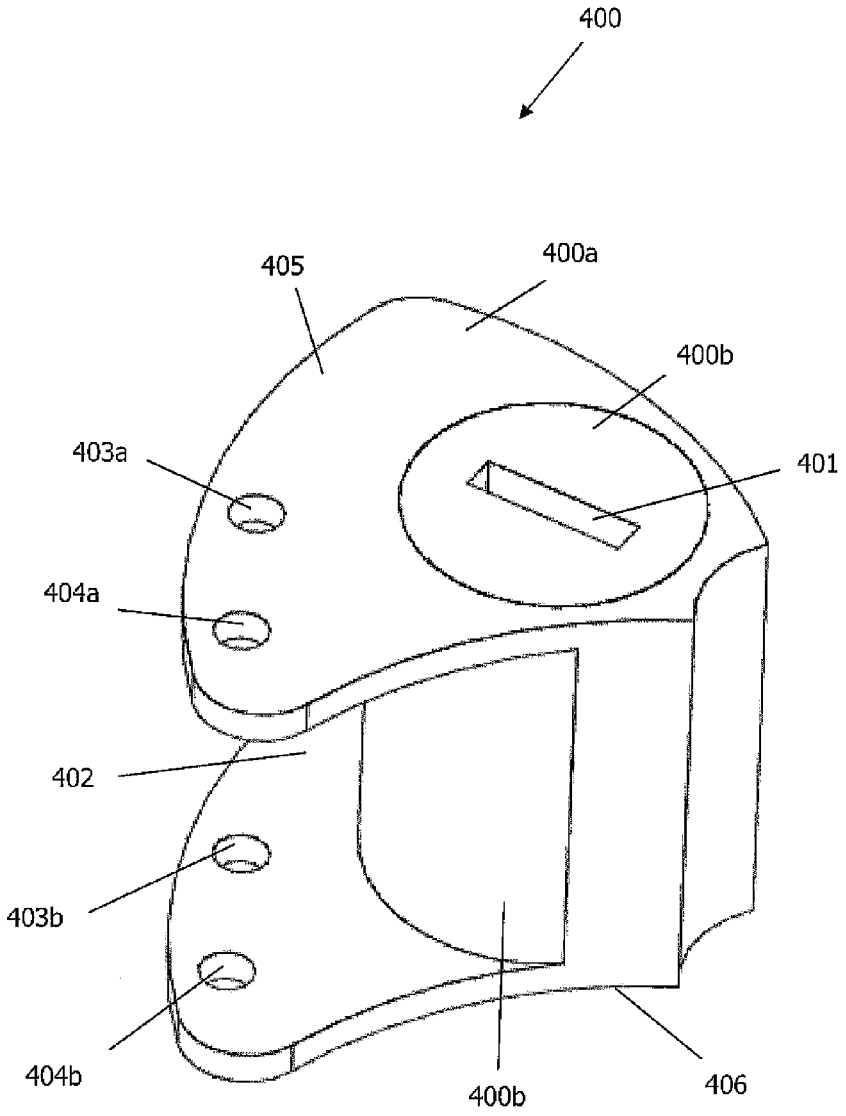

Embodiments of the invention will be described in the following with reference to the attached drawings wherein it shown by:

FIG. 1 a first embodiment of a magazine 1 according to the invention with magnet bodies 2 received therein;

FIG. 2 *a*)-*c*) an empty magazine element 100 of magazine 1 according to FIG. 1 in different views;

FIG. 3 the magazine 1 according to FIG. 1 inserted in a coil arrangement 5;

FIG. 4 the magazine 1 shown in FIG. 1 with a predetermined orientation of the individual magazine elements relative to each other so that the magazine 1 assumes a closed, circular configuration;

FIG. 5 a snap-shot during the transfer of the magnet bodies 2 from the magazine 1 according to FIG. 4 to the rotor 150 of a permanent magnet generator;

FIG. 6 the rotor 150 of a permanent magnet generator shown in FIG. 5 after the transfer of the magnet bodies 2;

FIG. 7 a second embodiment of a magazine 1' according to the present invention with magnet bodies 2' received therein;

FIG. 8 *a*)-*c*) an empty magazine element 1' of the magazine according to FIG. 7 in different views;

FIG. 9 the magazine 1' according to FIG. 7 inserted in a coil arrangement 5';

FIG. 10 the magazine shown in FIG. 7 with a predetermined orientation of the individual magazine elements relative to each other so that the magazine assumes a closed configuration;

FIG. 11 a snap-shot of the transfer of the magnet bodies from the magazine to the rotor of a permanent magnet generator;

FIG. 12 the rotor of a permanent magnet generator shown in FIG. 11 after the transfer of the magnet bodies;

FIG. 13 a third embodiment of a magazine 1" according to the present invention;

FIG. 14 *a*)-*c*) an empty magazine element 100" of magazine 1" according to FIG. 13 in different views;

FIG. 15 *a*), *b*) a respective coil arrangement 5"*a*), 5"*b*) with a magazine 1" inserted therein;

FIG. 16 *a*), *b*) the magazines 1" shown in the FIGS. 15 *a*), *b*) respectively, with a predetermined orientation of the individual magazine elements relative to each other so that the magazine 1 assumes a closed, circular configuration;

FIG. 17 *a*), *b*) a snap-shot during the transfer of the magnet bodies 2"*a*), 2"*b*) from the two magazines 1" according to the FIGS. 15 *a*), *b*) to the rotor 150 of a permanent magnet generator;

FIG. 18 *a*), *b*) the rotor 150 of a permanent magnet generator shown in the FIGS. 17 *a*), *b*) after the transfer of the magnet bodies 2"*a*) or 2"*b*) to the rotor;

FIG. 19 a handling system constructed according to the invention in a top view;

FIG. 20 an individual magazine element of the handling system according to FIG. 19, in a perspective view;

FIG. 21 the handling system illustrated in FIG. 19, in a perspective view in which both magazines assume a first position;

FIG. 22 the handling system of the invention according to FIG. 19, in a perspective view in which both magazines are in a second position;

FIG. 23 the handling system of the invention according to FIG. 19, in a perspective view in which both magazines are in a third position;

FIG. 24 the handling system according to FIG. 23, in a top view;

FIG. 25 a further embodiment of a magazine constructed according to the invention;

FIG. 26 a magazine element of the magazine according to FIG. 25; and

Figure 27:
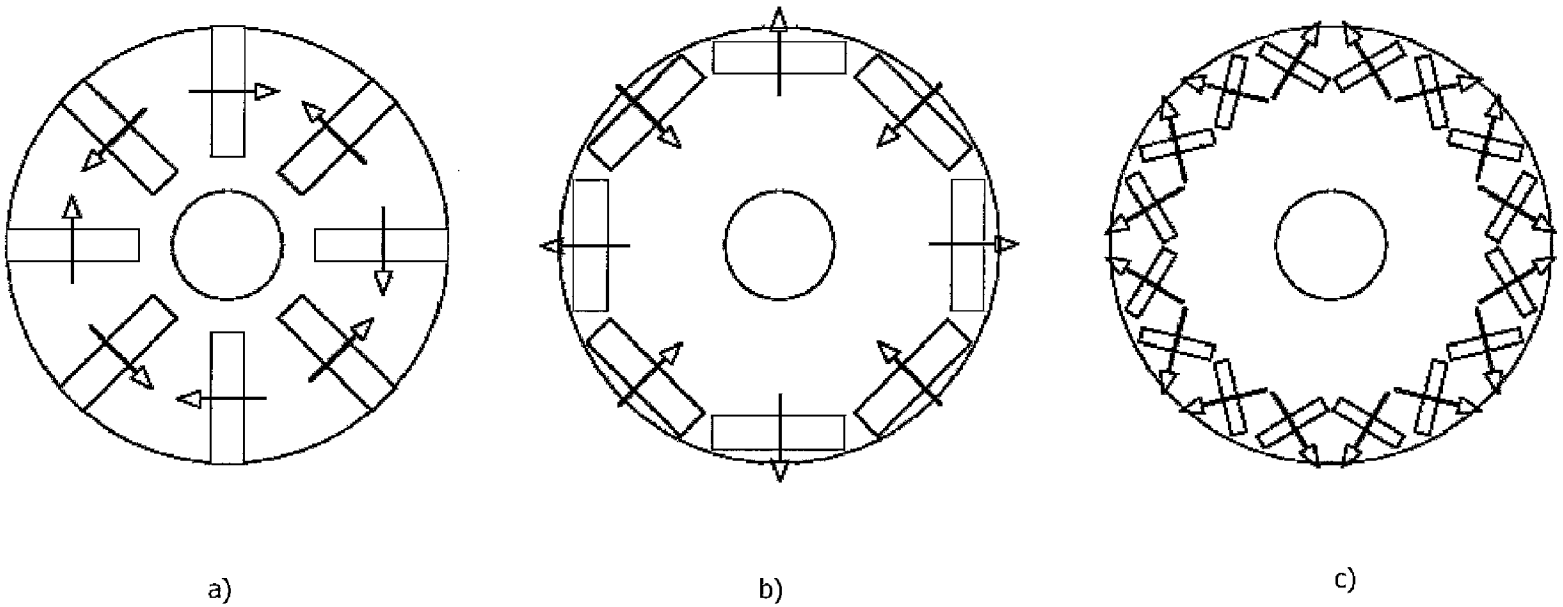

FIG. 27 *a*)-*c*) arrangements of magnet bodies which can be implemented with the described magazines constructed according to the invention.

FIG. 1 shows in a top view a magazine 1 constructed according to the invention which is composed of a plurality of magazine elements 100 whose configuration is shown in the FIGS. 2*a-c*, wherein the FIGS. 2*a, b* are a perspective view and FIG. 2*c* is a plan view of the front side 102 of the magazine element 100. Each magazine element 100 is completely made from austenitic steel, for example by means of a wire erosion or grinding process, and has an approximately triangular base area. As shown particularly by FIG. 2*c*, the base area of a magazine element 100 in the illustrated embodiment is an approximately equilateral triangle so that two intersecting sides form an angle of 60° each.

Approximately in its center and extending vertically to the base area 108, each magazine 100 has a seat or cavity 101 for receiving a magnet body 2. In the described embodiment, the open cavity extends over the entire thickness of the magazine element, i.e. between the front side 102 and the rear side 103 of the element. To provide a support for a magnet body 2 inserted in the cavity 101, a respective supporting ring 140 is provided on the rear side 103 of the magazine elements 100 centrally with respect to the rear opening of cavity 101. In the described embodiment, that supporting ring 140 is also made from nonmagnetic steel and is screwed into a corresponding flat thread on the rear side 103 of the magazine element 100 via an external thread circumferentially provided on the supporting ring.

In an embodiment which is not illustrated, the supporting ring can also be simply bonded onto the rear side 103 of the magazine element 100, again in such a manner that a magnet body 2 inserted into the cavity 101 is supported.

As shown by the illustrations of the FIGS. 2 *a*) and *b*), in the described embodiment, each magazine element includes lateral surfaces 106, 107, and 108, wherein at least the first two lateral surfaces serve as contact surfaces at the handling of the magazine which will be described in more detail in the following, particularly with reference to FIG. 4.

According to the illustrations in FIG. 2, a magazine element 100 includes complementary connecting elements at both corner points of the side of the triangular base area to which the cavity 101 vertically extends, and two directly adjacent magazine elements are movably connected to each other by said connecting elements.

In the described embodiment of the magazine according to the invention, coupling is implemented through a hinge-type connection between the individual magazine elements 100. For this purpose magazine elements 100 include two mutually spaced hinge legs 110, 120 at one of the two corner points of the said side which each include two mutually aligned bores 112. At the other corner point of the said side of the equilateral base area a single hinge leg 130 is provided which is also punched. The same is arranged in such a manner that it can be inserted between the two legs 110, 120 of an adjacent magazine element, and the bore in leg 130 is then aligned with the bores in the legs 110, 120 of the adjacent magazine element so that the movable coupling of adjacent magazine elements can be completed using a riveted bolt 3 (see FIG. 1).

The magazine according to the invention can be constructed in the described manner by stringing together a plurality of magazine elements 100 that are arranged as chain links. In the embodiment shown in FIG. 1, the magazine 6 according to the invention comprises magazine elements 100 which, as described above, each have a base area of an equilateral triangle (to be explained in more detail below).

By the described coupling of the individual magazine elements 100 which here provides a one single degree of freedom between two adjacent magazine elements in the form of a rotational axis, the entire magazine can in the end assume an arbitrary number of configurations by moving all magazine elements relative to the respective neighboring elements.

For facilitating the handling of the magazine, in the described embodiment, each magazine comprises in addition to the stop surfaces 106, 107 already described stop surfaces 115, 125 and 135 in the region of the hinge legs. As shown by the Figures, the surfaces concerned are the lateral end faces 115, 125 of the two adjacent hinge legs 110, 120 on the one side and also the stop surfaces 135 on both sides of the hinge leg 130 which extend vertically to the drawing plane in the illustration according to FIG. 2. As can be seen in FIG. 2*c*, only one of these two stop surfaces 135 is visible, whereas the lower stop face is concealed by the leg 130.

As directly apparent from the configuration of the magazine 1 represented in FIG. 1, said configuration is characterized in that the said stop surfaces 115, 125 cooperate with the associated stop surfaces 135 of the respective adjacent magazine element so that twisting of the magazine elements relative to each other under a maximum orientation is blocked. Thus the magazine according to the invention can be changed to a first predetermined configuration shown in FIG. 1 in which the magnet bodies are each oriented vertically to the longitudinal axis of the link chain.

In the described embodiment the magnet bodies are produced by a generally known powder-metallurgical process not further explained. The configuration is block-shaped corresponding to the cavity 101, the dimensions being slightly smaller than those of the cavity so that the magnet body is prevented from getting jammed in the cavity. The magnet bodies are fully received by the cavity 101, i.e. they do not protrude over the front side 102 of the magazine element 100. This is not the case in other embodiments, i.e. the magnet body has an extension in the direction of the front and rear sides of the magazine element which is larger than the thickness of the magazine element.

After loading the individual magazine elements 100 with a corresponding magnet body 2 and after adjusting the configuration of the magazine 1 shown in FIG. 1, the magazine can be inserted into a corresponding coil arrangement 5, which comprises six individual coils 5*a*-5*f*. The spacing of these individual coils is such that the respective magnet body is arranged approximately centrally in its corresponding coil and insofar "views" a homogeneous magnet field for the predetermined alignment of the elementary magnets. The arrows plotted in FIG. 5 indicate the respective direction of the magnet field H for the coil sections 5*a*-5*f*. Due to the different directions of electric current in the coil sections, indicated in FIG. 3, adjacent magnet bodies in the magazine are magnetized in opposite directions. It will be understood that this magnetization direction can be arbitrarily chosen, depending on the respective application, particularly by adjusting the direction of electric current in the coils.

After the magnetization of the magnet bodies 2 in the magazine 1, the latter can be removed from the magnet arrangement 5 and its configuration can be changed from the first configuration to a second configuration, for transferring the magnetized magnet bodies 2 for example to cavities of a rotor that represents the rotor of a permanent magnet generator. This second configuration of chain 1 is shown in FIG. 4. As mentioned, the adjacent magazine elements 100 are tilted relative to each other in such a manner that the respective stop surfaces 106, 107 contact each other so that said six links having an equilateral base area assume a closed annular configuration, while the respective magnetization B of adjacent magnet bodies in the magazine runs in opposite directions as a result of the above-described directions of electric current in adjacent coils 5*a*-5*f*.

FIG. 5 shows the magazine 100 that has been adjusted as shown in FIG. 4 arranged below a rotor 150 with cavities 151 to which the magnetized magnet bodies retained in the magazine are transferred. To this end, the rotor 150 and the magazine 100 are first aligned with each other. Then the cavities of both parts are aligned, i.e. overlapped, by being relatively rotated about their axes. This situation is illustrated in FIG. 5. As the configuration of the magazine or the relative position of the cavities to each other in the described second configuration are adjusted to the relative position of the rotor cavities, the cavities of both devices 100, 150 can be overlapped with each other. Then the magnetized magnet bodies 2 can be transferred or simply shifted from the magazine cavities 101 to the rotor cavities 151, in the present case by being axially displaced.

For this purpose the magnetized magnet bodies 2 are pushed from the rear side 103 of the magazine element 100 towards the front side 102 to be finally ejected from the respective cavity 101 and loaded into the corresponding cavity 151. This operation can be performed using a device which is not illustrated and which is constructed as a post having a plurality of fingers so that the magnetized magnet bodies are shifted into the rotor cavities 151 by said post being axially moved relative to the magazine 100 or the rotor 150. It will be appreciated by those skilled in the art that the described arrangement of the post can be configured in such a way that all magnet bodies are simultaneously transferable from their respective cavities 101 to their corresponding cavities 151 in the rotor 150 in a single work step.

FIG. 6 shows the loaded rotor 150.

The FIGS. 7-12 illustrate a second embodiment of the invention. It should be noted that only the differences from the first embodiment will be described, in order to avoid unnecessary repetitions. Correspondingly, similar or identical features in the Figures are identified by similar or identical reference signs. As shown by FIG. 7, the magazine 1' in this embodiment again comprises six magazine elements 100', wherein each magazine element 100' comprises two separate cavities 101', 101' that extend parallel to and differently spaced from the lateral surface 108. Both cavities 101', 101' are again open to the front side 102 of the magazine element 100'. On the rear side a supporting ring 104 is provided, which blocks the rear-side openings of the cavities 101', 101' and thus carries the two magnet bodies 2', 2' inserted therein. As apparent from the FIGS. 7 and 8, the remaining configuration of the magazine 1' or of the magazine elements 100' is not different from that of the first embodiment.

FIG. 9 shows the magazine illustrated in FIG. 7 with magnet bodies 2', 2" received therein and in its condition inserted into a corresponding coil arrangement 5', while assuming its first configuration. The magnet arrangement 5' or its coil windings are oriented in a manner such as to obtain the changing magnetic field H plotted in the longitudinal direction of the coil arrangement and symbolized by the arrows shown in that Figure. The elementary magnets in the magnet bodies are aligned in a corresponding manner.

That alignment of the magnetization B is also apparent from FIG. 10, which shows the magazine in its second configuration imparted to the magazine by the magazine elements 100' being moved relative to each other. In the present embodiment said second configuration also represents a closed circle in the top view of FIG. 10. As shown by a comparison with the first embodiment in FIG. 4, the magnetization B of the magnet bodies 2', 2" in the second configuration of the magazine runs in the radial direction, whereas it runs tangentially in the first embodiment.

FIG. 11 shows the orientation of the cavities 151', 151" of the rotor 150' relative to the cavities 101', 101" of the magazine 100', for transferring the magnetized magnet bodies received in the magazine to the rotor.

FIG. 12 illustrates the loaded rotor 150'.

The FIGS. 13 to 18 illustrate a third embodiment of the invention, whereas only the differences from the above-described embodiments will be discussed in the following. Identical or similar parts and components are identified by identical or similar reference signs. As shown by FIG. 13, in the present embodiment, the magazine 1" comprises precisely three magazine elements 100", each magazine element 100", similar to the magazine according to FIG. 1, comprising a single cavity 101" whose longitudinal axis again extends vertically and centrally with respect to the lateral surface 108 (see FIGS. 14 *a*) to *c*)). Both lateral legs 106, 107 together form an angle of 120°, which is different from that of the magazine element according to FIG. 1. The cavity 101" is again open toward the front side 102 of the magazine element 100", and on the rear side 103 a supporting ring 140 is provided that blocks the rear-side opening of the cavity 101" and thus carries the magnet body inserted therein. The central magazine element 100" in the magazine 1" of FIG. 13 is connected to its adjacent magazine elements, which are constructed identically with the central magazine element, by means of the hinge-type connection described for the previous embodiments. Also, in this third embodiment, corresponding stop surfaces on adjacent magazine elements 100" are effective for easy adjusting of predetermined pivoted positions of individual magazine elements 100" altogether.

The FIGS. 15 *a*), *b*) respectively illustrate a magazine shown in FIG. 13, which is inserted into a corresponding coil arrangement 5"*a* or 5"*b*, while assuming its second configuration. As apparent from the illustrated direction of electric current of the coil windings or from the plotted field vector H, said two coils 5"*a* or 5"*b* are different regarding the field direction so that the magnetization of the magnet bodies (not illustrated in the FIGS. 13-15 for the sake of convenience) received in the cavities 101" of the magazines run in mutually opposite directions. This different orientation of the magnetization in said two magazines, which are illustrated in FIG. 15 and which are otherwise identical, is apparent from FIGS. 16 *a*), *b*) respectively showing a magazine in its second configuration, which is imparted to the magazine by relatively moving the magazine elements 100" and which represents a closed circle configuration in the top view of that Figure. A comparison of the FIGS. 16 *a*) and *b*) shows that the magnetization of the magnet bodies 2"*a* and 2"*b* runs in mutually opposite directions.

On the other hand, the FIGS. 17 *a*), *b*) show the respective orientation of the cavities 151 of the rotor 150 relative to the cavities 101" of the respective magazine 100", for transferring the magnetized magnet bodies 2"*a*, 2"*b* received in both magazines to the rotor. As can be seen, the magnet bodies 2"*a* contained in said one magazine are transferred from the magazine to the rotor 150 in a first transferring step, as already described in the first and second embodiments, the result of that first transferring step being shown in FIG. 18 *a*). Thereafter, the rotor loaded with the magnet bodies 2"*a* is turned up toward the second magazine carrying the magnetized magnet bodies 2"*b*, see FIGS. 16 *b*), 17 *b*). After the transfer of these magnets to the rotor in the manner already described, the final result as shown in FIG. 18 *b*) is obtained, i.e. the rotor 150 which is completely loaded with the magnet bodies 2"*a*, 2"*b*.

A further embodiment of a magazine and a handling system of the invention will be described with reference to the FIGS. 19 to 24 in which two those magazines are used. FIG. 19 shows in a top view the handling system 300, which in the described embodiment includes a flat, elongate guide plate 310. Approximately symmetrically to the center, two spaced guide grooves 312*a, b* are arranged which linearly extend parallel to each other at a constant spacing from each other in the sections A1, A2. Within section A3, both guide grooves each assume circularity, while their directions of rotation are opposed to each other. In the described embodiment, the guide plate is made from a synthetic material but it can also be made from a compound material or from metal.

Each of the two guide grooves 132*a, b* is assigned a magazine 199, which in the described embodiment each comprise four magazine elements 200, which each include a single cavity 201 for receiving a magnet body. Magazine elements 200, which are directly adjacent to each other, are coupled to each other by a connecting element constructed as a pivot arm 215. To this end, bores are provided in the magazine element 200, with respective pin axes 210, 211 extend through said bores, while in the described embodiment one pin axis further extends through corresponding bores on the respective end of the pivot arm 215 so that the same is articulated to the magazine element 200 so that it can rotate. In the described embodiment, the magazine elements and the pivot arms are both made from metal.

Both magazines 199, which in the described embodiment each comprise four magazine elements 200, are each articulated to a coupling element 230 in the form of a block-shaped element by means of a coupling arm 220, while said coupling arm 220 is articulated to the right magazine element 200 in the manner already described above in connection with the connecting elements or pivot arms 215. In the same manner a pivot axis 321 extends through a corresponding bore in the coupling element 230 so that the coupling arm 220 is articulated in a rotatable manner to the coupling element 230. Accordingly, the coupling of the coupling arm 220 to a magazine element and to the coupling element 230 is similar to the coupling of a pivot arm 215 to two adjacent magazine elements, wherein the axial length of a coupling arm 220 and a pivot arm 215 can be different. In the described embodiment, all pivot arms 215 between the magazine elements have the same axial length. In particular, all pivot arms and also all magazine elements can be identically constructed.

The above-mentioned pin axes 210, 211 and 231 respectively extend toward the guide plate 310 and into the guide grooves 212*a* or 212*b*. They protrude into the respective guide groove by journals so that during the movement of the coupling element 230 both magazines are positively guided in the guide grooves. During the movement of the coupling element 230 parallel to the guide grooves to the left in the drawing plane, both magazines with their magazine elements first move in the form of a linear chain within the sections A1 and A2 and after entry into section A3, said linear chain assumes circularity as a result of the configuration of said two guide grooves 312*a, b*.

The magazine elements and the coupling element can each be supported with a flat front surface on the flat plate and can be easily displaced for moving the magazine on the plate due to small static and sliding friction coefficients between the guide plate 310 and the magazine elements 200. For this purpose suitable materials of the magazine elements and the guide plate are chosen.

The handling system according to FIG. 19 includes in section A2 a linear coil arrangement 250, which is shown cut open in that Figure. Within the circle formed by one of the two guide grooves 312*a, b*, a centric bore 320 as well as four circumferentially equally spaced bores 321 are arranged in the guide plate respectively, the bores 321 lying on an imaginary circle and centrically with respect to the centric bore 320.

FIG. 20 shows a perspective view of a configuration of an individual magazine element 200. In the described embodiment, all magazine elements are identically constructed, and the magazine elements 200 of the two magazines become merged by rotating the same 180° about an axis that extends vertically to the axes 210, 211. Insofar, in the illustration of FIG. 19, the front side 205 of the magazine elements 310 in said one magazine points away from the guide plate 310, whereas that front side 205 of the magazine elements in the other magazine is supported on the guide plate and the opposite front side 206 is directed away from the guide plate. The magazine elements have a sickle-like base shape, with a cavity 201 for receiving a magnet body extending through the magazine element 200. Parallel to the longitudinal extension of the cavity 201 bores 203*a*, 203*b* or 204*a*, 204*b* are provided, which respectively correspond to each other and which are spaced from each other by a recess 202 in the body of the magazine element 200. The pivot arms 215 shown in FIG. 19 or, in the case of the magazine element 200 that is arranged directly adjacent to the coupling element 230, the element 220 protrude into that recess.

FIG. 21 is a perspective view of the handling system shown in FIG. 19. Differently from the representation in FIG. 19, the magnetizing coil arrangement 250 is not shown in section but is instead illustrated in full. In its simplest configuration it can be formed as a linear coil. For the sake of convenience, the driving mechanism, for example in the form of a linear drive, which is coupled to the coupling element 230 for moving the two magazines, is not illustrated.

In the positions of the two magazines 199 within section A1 which are shown in the FIGS. 19, 21, the respective cavities 201 of the totally eight magazine elements 200 can be loaded with magnet bodies. This can be implemented in such a way that the individual cavities 201 are loaded one after the other from the top. In a different embodiment, a magnet body feeding device is provided, which is arranged in section A1 above the two magazines and which enables the magnet bodies to be inserted into all cavities of the magazine elements simultaneously, i.e. in a single work step. During this process, a magnet body is placed above a corresponding cavity 201 and all magnet bodies are simultaneously transferred to the cavities 201 of the magazine elements using a dedicated mimic.

After loading the magazine elements within section A1, see FIG. 19, both magazines are transferred to the magnetization device in the form of a coil arrangement 250 disposed in section A2, by means of the described positive guiding. In the illustrated embodiment, the coil arrangement is constructed as a simple linear coil that produces an axial magnetic field, whereby the magnet bodies of both magazines disposed in the cavities 201 of the magazine elements are simultaneously magnetized.

In the described embodiment, the inserted magnetizing bodies are anisotropic, for example, in such a manner that they can be magnetized only in the magnetizing axis or orientation identified by reference sign U in FIG. 21. Insofar, such a magnet body 4, 4' inserted into a cavity 201 can only be magnetized in two directions that are offset to each other by 180 degrees. As apparent, these directions lie at an angle to the coil axis, which determines the magnetic field direction in the axial coil arrangement that is employed. Insofar, during magnetization, that component of the field generated by the coil arrangement is effective which lies parallel to the possible magnetizing direction U. As the angle between the possible magnetizing directions and the field direction is comparatively small, the magnet field generated by the coil arrangement 250 is sufficient for magnetizing the inserted magnet bodies.

FIG. 22 shows the situation or position of the coupled magazines in which the two magazines or their magazine elements 200 are arranged inside the coil, i.e. in section A2, for performing the magnetization. After magnetization, the coupling element 230 and hence both magazines are moved further to the left in the Figure by means of the driving mechanism (not shown) so that both magazines are transferred to section A3. As a result of the magazines being positively guided in the two guide grooves 312*a, b*, the linear configuration of the magazine becomes a circular configuration as shown in the perspective view of FIG. 23. Due to the shape change of the two magazines to circularity, with a different sense of rotation, the orientation of the magnetization of the magnet bodies is just rotated by 180 degrees. For the sake of clarity, only one magazine element of each of the two magazines illustrated in FIG. 23 is shown in its condition loaded with a magnet body 4 and 4' respectively, and the magnetization of these bodies in opposite directions, M1 and M2 respectively, is also indicated in that Figure.

FIG. 24 shows the situation of FIG. 23 in a top view, in which the coil arrangement 250 is again shown in a sectional view, for reasons of simplicity. Further, for reasons of clarity, the total number of eight magnet bodies is not shown so that it can be seen that the transfer bores 321 in the guide plate 300 are each aligned with the cavities 201. Section A3 provides a delivery section in which the magnetized magnet bodies retained in both magazines can be transferred to a component of a magnetic system such as a rotor of an electric motor. This can be accomplished by fingers extending through the above-mentioned transfer bores and pushing the magnetized magnet bodies stored in the cavities 201 out of the cavity, in order to achieve the embodiment described with reference to the FIGS. 10 to 12 and 16 to 18 respectively. As can be seen in FIG. 24, in section A3 both magazines have assumed a circular configuration as a result of the magazines being positively guided in the guide plate. In this circular configuration, the four magazine elements of a magazine circumferentially contact associated contact surfaces, while the two rotation axes assigned to a magazine element and defined by the arrangement of the two pin axes 230, 231 have a circumferential distance $\alpha$ that is smaller than half of the circumferential extension $\beta$ of an individual magazine.

The transfer of the magnet bodies is first carried out on one of the two magazines, wherein all magnet bodies of the magazine have the same magnetization direction. Thereafter, the component is linearly moved over the second magazine and the magnet bodies that are stored therein and that are magnetized in the opposite direction from the first magazine are transferred to the component so that the magnetization direction of the magnet bodies disposed in the component can alternate, for example, corresponding to the requirement of a rotor of an electric motor.

A further embodiment of a magazine constructed according to the invention will be described with reference to the FIGS. 25 and 26. This embodiment is similar to that of a magazine according to the FIGS. 19-24, the difference being that the magazine 399 comprises magazine elements 400 that are composed of a base body 400*a* and a magnet body receiver 400*b*, which in the described embodiment is cylindrical and arranged so as to be rotatable with respect to that base body. Base bodies 400*a* of adjacent magazine elements are again coupled to each other by pivot arms 415 that are each articulated to a base body in a rotatable manner, see FIG. 25, which shows a magazine element constructed in this manner and assuming configuration of a linear chain in that Figure. It can be seen that the coupling of the individual magazine elements among each other is identical with the embodiment described with reference to the FIGS. 19-24, wherein a respective pivot arm 415 that is arranged between two magazine elements 400 or the base bodies 400*a* thereof is fixed to the respective base body by means of pin axes 410, 412.

In the described embodiment, the magnet body receiver 400*b* is cylindrical, with a respective cavity 401 extending parallel to the cylinder axis, see FIG. 26.

The magazine of the invention shown in FIG. 25 is constructed so that during the change of the magazine from the linear configuration in FIG. 25, the cavities 401 and thus the magnet bodies contained therein are automatically brought to a predetermined orientation. To this end, a respective rigid rotatable arm 417 is articulated in a rotatable manner to the magnet body receiver 400*b* through a pin axis 418, and said rotatable arm is articulated to the adjacent magazine element 400 or to its base body 400*a*, see FIG. 25. As can be seen in that Figure, in the described embodiment, the rotatable arm 417 is coupled to the adjacent magazine element 400 on the same pin axis to which the pivot arm 415 is articulated for connection to the adjacent base body.

If the magazine 399 shown in FIG. 25 is positively guided by means of a guide plate and through pins of the pin axes engaging with said guide plate, similarly to the magazine described with reference to the FIGS. 21-24, a predetermined orientation of the cavity 401 and thus of a magnet body received therein will be obtained upon adjusting a particular configuration of the magazine by coupling a magnet body receiver 400*b* to the base body 400*a* of an adjacent magazine element 400. The orientation which is desired in each case can be adjusted by a corresponding geometric arrangement and articulation of the rotatable arm 417 to the magnet body receiver or to the base body. Accordingly, the magazine of the invention shown in FIG. 25 has the advantage that the respective orientations of the magnet bodies are automatically adjusted, without requiring manual rotation of the magnet body receiver in the respective magazine element, in particular for the magnetization of the magnet bodies and/or for the insertion of the magnet bodies into a component of a magnetic system such as a rotor.

For the sake of clarity FIG. 26 shows a single magazine element 400 of the magazine according to FIG. 25. The magazine element shown in FIG. 26 differs from the magazine element shown in FIG. 20 only in that the cavity 401 is arranged in a magnet body receiver 400*b*, which itself is arranged so as to be rotatable with respect to the base body 400*a* of the magazine element 400. In the described embodiment, the base body 400*a* has a cylindrical recess, the magnet body receiver 400*b* extends into said recess in a rotatable manner.

The FIGS. 27*a, b, c* are schematic diagrams of exemplary embodiments of magazines according to the invention, which have all been transformed to a circular configuration and which differ from each other by the respective orientation of the cavities or by the magnetization of the magnet bodies contained therein. With the described magazines according to the invention, such magnet body arrangements can be implemented in a simple manner and are then transferred for example to a rotor of an electromagnet driving mechanism in the manner described.

LIST OF REFERENCE SIGNS

1, 1', 1" magazine
2, 2', 2"*a, b* magnet body
3 rivet
4, 4' magnet body
5, 5', 5"*a, b* coil arrangement
5*a*-5*f* single coil of coil arrangement 5
100, 100', 100" magazine element
101, 101', 101" cavity
102 front side of magazine element 100, 100'
103 rear side of magazine element 100, 100'
106, 107, 108 lateral surface
110 hinge leg
112 bore
115 contact surface
120 hinge leg
122 bore
125 contact surface
130 hinge leg

132 bore
135 contact surface
140 supporting ring
150, 150' rotor
151, 151' cavity
H magnetic field
B magnetization in magnet body 2, 2', 2"*a, b*
199 magazine
200 magazine element
201 cavity
202 recess
203*a, b* bore
204*a, b* bore
205, 206 front surface
210, 211 pin axis
215 pivot arm
220 coupling arm
230 coupling element
231 pin axis
250 coil arrangement
300 handling system
310 guide plate
312*a, b* guide groove
320 centric bore
321 transfer bore
A1, A2, A3 section
H magnetic field
B magnetization of magnet body 2, 2', 2"*a, b*
U magnetization axis
M1 magnetization of magnet body 4
M2 magnetization of magnet body 4'
399 magazine
400 magazine element
400*a* base body
400*b* magnet body receiver
401 cavity
402 recess
403*a, b* bore
404*a, b* bore
410 pin axis
411 pin axis
415 pivot arm
417 rotatable arm
418 pin axis

What is claimed is:

1. Magazine for holding magnet bodies during their magnetization and for inserting the magnetized magnet bodies into a component of a magnetic system, wherein the magazine comprises a plurality of interconnected and mutually movable magazine elements, and wherein each magazine element has at least one cavity for receiving a magnet body, and wherein the at least one cavity of each magazine element includes an opening for the insertion and/or removal of a magnet body, wherein on the opposite side of the opening of the cavity a support is arranged, for supporting a magnet body received in said cavity.

2. Magazine according to claim 1, wherein the magazine elements are interconnected in a chain-like manner so that at least one magazine element is movably connected to two adjacent magazine elements respectively.

3. Magazine according to claim 1, wherein two motional degrees of freedom are provided between adjacent magazine elements, wherein both motional degrees of freedom are rotational degrees of freedom.

4. Magazine according to claim 1, wherein between adjacent magazine elements an elongate connecting element is disposed, which is articulated to both adjacent magazine elements in a rotatable manner, wherein both assigned rotation axes are oriented parallel to each other.

5. Magazine according to claim 1, wherein the magazine can be brought to the configuration of a substantially linear chain by aligning the mutually movable magazine elements.

6. Magazine according to claim 1, wherein the magazine can be brought to the configuration of a circle or circular segment by aligning the mutually movable magazine elements.

7. Magazine according to claim 4, wherein the magazine can be brought to the configuration of a circle or circular segment by aligning the mutually movable magazine elements and wherein after bringing the magazine in the circular or circular segment configuration of the magazine, the rotation axes for coupling the respective connecting elements to the magazine elements lie on a circle or circular segment, wherein the circumferential spacing of the two rotation axes of a magazine element is smaller than half of the entire circumferential extension of a magazine element.

8. Magazine according to claim 1, wherein adjacent magazine elements each comprise a base body, with a magnet body receiver being arranged so as to be rotatable with respect to the base body, wherein the magnet body receiver provides the at least one cavity of the respective magazine element for receiving a magnet body.

9. Magazine according to claim 8, wherein a magnet body receiver is motionally coupled to the base body of an adjacent magazine element, particularly by means of a rotatable arm.

10. Method for holding magnet bodies during their magnetization and for inserting the magnetized magnet bodies into a component of a magnetic system, the method comprising the steps of:

providing a magazine, wherein the magazine comprises a plurality of interconnected and mutually movable magazine elements, each magazine element comprising at least one cavity for receiving at least one magnet body, respectively, each of said at least one cavity providing a support for supporting the at least one magnet body received in said cavity;

loading the magazine with a plurality of magnet bodies, wherein the at least one magnet body is supported by a support arranged in said cavity;

adjusting a first predetermined configuration of the magazine by moving individual magazine elements relative to each other;

magnetizing the magnet bodies retained in the magazine, wherein the magazine assumes the first predetermined configuration;

adjusting a second predetermined configuration of the magazine by moving individual magazine elements relative to each other;

transferring the magnetized magnet bodies to a component of a magnetic system, wherein the magazine assumes the second predetermined configuration.

11. Method according to claim 10, wherein the step of magnetizing the magnet bodies retained in the magazine at least comprises inserting the loaded magazine into a magnetization arrangement such as a magnetization coil, exciting the magnetization coil and removing the magazine from the magnetizing coil.

12. Method according to claim 10, wherein the step of transferring the magnetized magnet bodies to a component of a magnetic system at least comprises aligning the loaded magazine which is in its second configuration with the component of the magnetic system and removing the magnet bodies from the respective cavities in the magazine and inserting the magnet bodies into corresponding cavities in the component of the magnetic system.

13. Method according to claim 10, wherein magnet bodies are inserted from the respective cavity of the magazine into a corresponding cavity in the component and aligned with said cavity, through a linear movement.

14. Method according to claim 10, wherein the magnet bodies of a magazine are simultaneously shifted from the respective cavity in the magazine into a corresponding cavity in the component of the magnetic system by means of a pusher-type post.

15. Handling system for magnet bodies comprising:

a magazine for holding magnet bodies during their magnetization and for inserting the magnetized magnet bodies into a component of a magnetic system, wherein the magazine comprises a plurality of interconnected and mutually movable magazine elements, and wherein each magazine element has at least one cavity for receiving a magnet body, and wherein the at least one cavity of each magazine element includes an opening for the insertion and/or removal of a magnet body, wherein on the opposite side of the opening of the cavity a support is arranged, for supporting a magnet body received in said cavity; and a magnetization arrangement for magnetizing the magnet bodies received by the magazine.

16. Handling system according to claim 15, further comprising a device for transferring the magnetized magnet bodies from the magazine to a component of a magnetic system such as an electromagnetic drive, a magnetic travel or angle system or the like.

17. Handling system according to claim 15, wherein a plate-like guiding device including a guide groove comprises at least two merging sections, wherein the guide groove is linear in a first section and circular in a second section and wherein the magazine is positively guided in said guide groove, for adjusting the first and the second configurations of the magazine.

18. Handling system according to claim 17, wherein two guide grooves are provided which are disposed in the plate-like guiding device and are spaced from each other, each guide groove comprising at least two merging sections, wherein both guide grooves extend in a linear fashion in a first section and in a circular fashion in a second section, with opposite directions of rotation.

19. The handling system of claim 15, wherein the magnetization arrangement comprises a coil arrangement.

* * * * *